United States Patent [19]

Vanbeber

[11] Patent Number: 4,750,710

[45] Date of Patent: Jun. 14, 1988

[54] STABILIZING JACK

[76] Inventor: Vernie F. Vanbeber, 51 East Orr, Chouteau, Okla. 74337

[21] Appl. No.: 15,517

[22] Filed: Feb. 13, 1987

Related U.S. Application Data

[63] Continuation of Ser. No. 847,133, Apr. 1, 1986, abandoned, which is a continuation of Ser. No. 640,028, Aug. 10, 1984, abandoned.

[51] Int. Cl.[4] ..... B66F 1/00

[52] U.S. Cl. ..... 254/1

[58] Field of Search ..... 254/1, 89 H, 133 R, 254/134, 132, 93 H

[56] References Cited

U.S. PATENT DOCUMENTS

| | | | |
|---|---|---|---|
| 2,062,549 | 12/1936 | Wold | 73/51 |
| 2,229,113 | 1/1941 | Mizer | 254/89 |
| 2,449,296 | 9/1948 | Haight | 254/86 |
| 2,507,879 | 5/1950 | Beaudoin | 103/54 |
| 2,549,321 | 4/1951 | Marshall et al. | 254/134 |
| 2,553,196 | 5/1951 | Leary | 254/1 |
| 2,571,615 | 10/1951 | Romeo | 254/86 |
| 2,606,744 | 8/1952 | Tracey | 254/86 |
| 2,652,625 | 9/1953 | Perkins | 254/133 R |
| 2,689,022 | 9/1954 | Neilson | 187/8.43 |
| 2,852,100 | 9/1958 | Smith | 187/8.43 |
| 3,048,237 | 8/1962 | Rutherford | 187/8.43 |
| 3,892,385 | 7/1975 | Andrist et al. | 254/133 R |
| 4,212,374 | 7/1980 | Bubik | 187/8.43 |
| 4,231,550 | 11/1980 | Castoe | 254/124 |

*Primary Examiner*—Frederick R. Schmidt
*Assistant Examiner*—Judy J. Hartman
*Attorney, Agent, or Firm*—Head & Johnson

[57] ABSTRACT

A method for stabilizing vehicles such as an automobile that is lifted off the ground for servicing and which has an upper passenger compartment portion supported by a suspension system from a lower portion which are the wheels and the axle. An upward force is applied to the axle of the vehicle while holding the passenger compartment against upward movement. The apparatus has an elongated cylinder, a power piston therein with a shaft extending out the upper end, and a craddle on the shaft for fitting the axle or differential portion of the vehicle. Chains with hooks are provided to connect the housing to the passenger compartment of the vehicle.

3 Claims, 3 Drawing Sheets

STABILIZING JACK

This is a continuation of co-pending application Ser. No. 847,133 filed on Apr. 1, 1986, which is a continuation of parent application Ser. No. 640,028, filed on Aug. 10, 1984; both applications are now abandoned.

BACKGROUND OF THE INVENTION

The present invention is concerned with a method and apparatus for stabilizing a vehicle which is lifted off the ground for service.

When certain work needs to be done on a vehicle such as changing the shock absorbers or the springs, it is a common practice to use a hydraulic lift to raise the automobile to above head height of the mechanic. A widely used jack or lift is one that has a large central hydraulicly operated shaft which is extendable from the floor level to a height of 8 or 10 feet or more. Adjustable arms are pivotally attached to the hydraulic lift so that after a car has been driven over the hydraulic shaft, then the arms can be extended outwardly so that they will be under the frame. Then the hydraulic means is actuated and the car is lifted to the desired height.

When this occurs, it is apparent that the wheels are not directly supported by the hydraulic shaft or the arms but are supported by the suspension system. The tires are hanging down from their normal position in relation to the upper portion of the car and is held there only by the suspension system which is under tension and not in compression which is normal. For service such as changing shocks, the operation may, in some instances, become dangerous. For example, when you take the rear shock loose, the rear end of the car, that is the wheel and shaft can drop up to three or four inches. This can cause an unbalance unstabilizing the car and there have been instances where the car has fallen from the rack, demolishing the car and endangering human lives. When changing a front coil spring after taking the ball joint loose, the spring can literally fly in an undetermined direction. This is, of course, very dangerous.

SUMMARY OF THE INVENTION

Broadly speaking, this is a method of supporting above the ground level, a vehicle having an upper portion such as a frame and body of a car supported by a suspension system such as springs, shock absorbers and the like from a lower portion such as the wheels and axle, etc. The vehicle may be lifted above the floor of the service garage to a desired height. Before performing any mechanical work on the vehicle such as removing shocks or springs, I maintain the upper portion or frame in a fixed position while independently applying upward force to the lower portion and holding the upper portion against additional upward movement.

In a preferred embodiment, I accomplish this by using an upright cylindrical housing having a base and a piston therein with a shaft extending above the upper end of the housing. The piston may be hydraulic or pneumatic or any other means for raising the piston. The upper end of the shaft is provided with a cradle for fitting on to the axle or other portion of the vehicle. One end each of a pair of chains is attached to the upper outer end of the housing and the other ends are for attachment to the upper portion or frame of the vehicle. These chains are attached in a manner in which they are substantially tight. As power is applied to the piston, the shaft is extended upwardly and forces the lower portion of the vehicle or the axle upwardly. However, the upper portion or frame of the car is held against upward movement by the chains. Thus, I effect a compression of the suspension system. A better understanding of the invention can be had from the following description taken in conjunction with the drawings.

DETAILED DESCRIPTION OF THE PREFERRED EMBODIMENT

Figure 1:
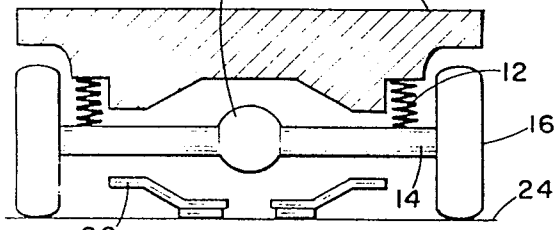
Fig. 1 (PRIOR ART)
FIG. 1 illustrates a conventional apparatus for raising a car for servicing.

FIG. 1 illustrates a conventional way of raising a vehicle such as a motor car above a work area. Shown thereon is a vehicle having an upper portion or frame 10 supported by suspension system such as springs 12 from an axle 14 having wheels 16 and a differential 18. The vehicle is driven over lifting means including arms 20 which are adjustable in a known manner from a hydraulic extending shaft 22 as shown in FIG. 2.

Figure 3:
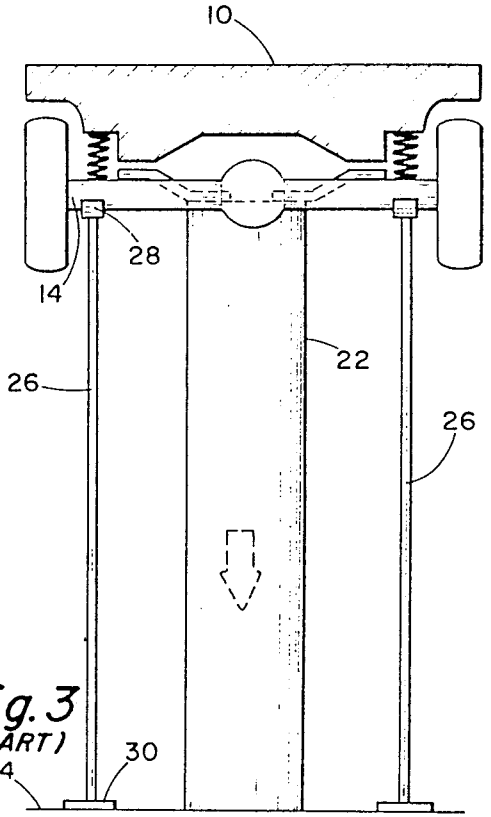
Fig. 3 (PRIOR ART)
FIG. 3 shows additional apparatus added to that of FIG. 2.
Figure 2:
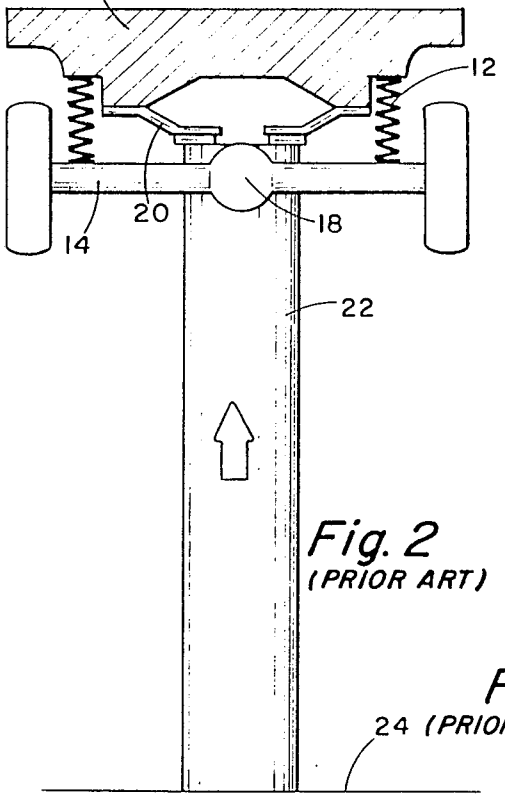
Fig. 2 (PRIOR ART)
FIG. 2 shows the car raised off the ground.

As can be seen clearly in FIG. 2, the hydraulic shaft 22 is acting through arms 20 to raise the vehicle high above the floor 24. When in this position with this particular embodiment of lift, the lower portion which includes the shaft 14 and the wheels are supported from the vehicle frame 10 only by the suspension system such as springs 12. This causes the springs 12 to be in tension rather than compression. It is not always desired to have the springs 12 in tension when performing certain mechanical operations on the vehicle. Frequently, as shown in FIG. 3, stands 26 having an upper cradle 28 and a base 30, are placed under the axle 14 and the shaft 22 is lowered so that the springs are once again in compression.

It is common practice to have shock absorbers in operation with conjunction with the springs 12. It is frequently necessary to change the shock absorbers. With the system just outlined, there is a large potential problem. If, in the embodiment of FIG. 3 one would remove the shock absorbers, the rear end portion of the frame 10 may drop several inches. This can be a dangerous situation inasmuch as a frame 10 is no longer level and is suspended 6 to 8 feet or more above the floor 24. Automobiles have been known to slide off of jacks in this particular predicament demolishing the automobile and endangering human lives.

Figure 6:
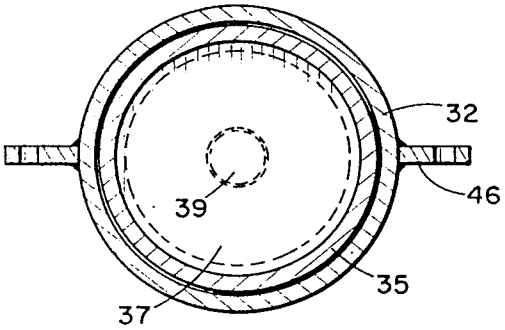
FIG. 6 is a view taken along line 6—6 of FIG. 5.
Figure 5:
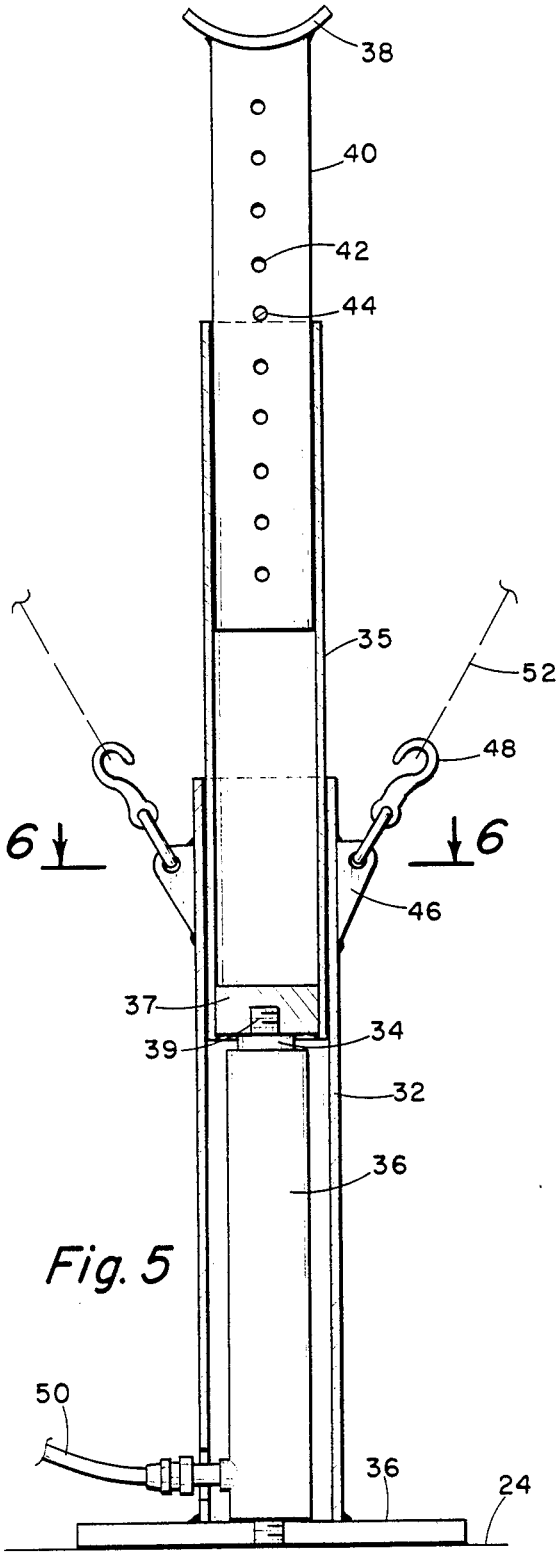
FIG. 5 is a view taken along the line of 5—5 of FIG. 4.
Figure 4:
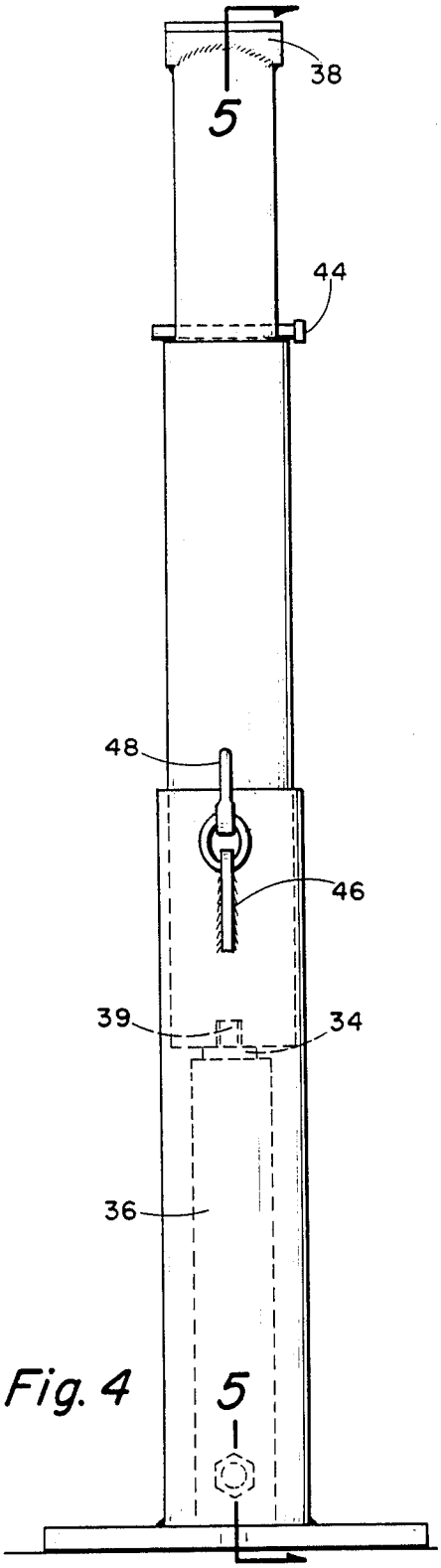
FIG. 4 illustrates the apparatus of the invention for applying upward force to a lower portion of a vehicle while holding the upper portion in position.

Attention is next directed to FIGS. 4, 5 and 6 for a description of the apparatus of my invention. Shown thereon is an elongated upright housing 32 which preferably is a large strong cylinder, e.g. 4 inches in diameter and which is supported at the bottom end by base 36 above floor 24. Mounted in housing 32 is a cylinder 36 having a piston 34 therein. The piston may be driven upwardly by fluid pressure through line 50 from a source not shown in a well known manner. The power source can be either compressed air or hydraulic fluid under pressure. Of course, other means of extending the piston can be used. The upper end of piston 34 is connected to extension 35 through member 37 in any manner to fix the two together. The upper end of extension 35 is provided with a second extension 40 which has a series of horizontal holes 42 there through. The upper end of second extension 40 is provided with a cradle 38 for fitting against the lower portion of the car such as the rear axle.

Ears 46 are provided approximately 180° apart on the upper end of housing 32 and are provided with hooks 48 which are connected to chains 52.

Although the apparatus shown in FIGS. 4 and 5 can be made of various materials and of the proper size to fit the particular need, I have built one of these which has the following dimensions. Housing 32 was made of high grade aluminum and was approximately 4½ inches in diameter with a wall thickness of ¼ inches, and had a height of 31 inches. Cylinder 36 was about 3¼ inches in diameter and about 18 inches in length and was also made of high grade aluminum having a wall thickness of about ¼ inches. The piston 34 was about 3 inches in diameter. The power which I used was compressed air and for a compressed air pressure of about 150 to 175 psi, you would have a lifting force equivalent to lifting 1,050 pounds. Extension 35 was about 32 inches long and 3½ inches in diameter and ¼ inches in thickness. The second extension 40 was about 22 inches long and likewise had a wall thickness of about ¼ inches. The holes 42 were about 2 inches apart which gave adequate adjustment in the vertical length of the apparatus.

Figure 9:
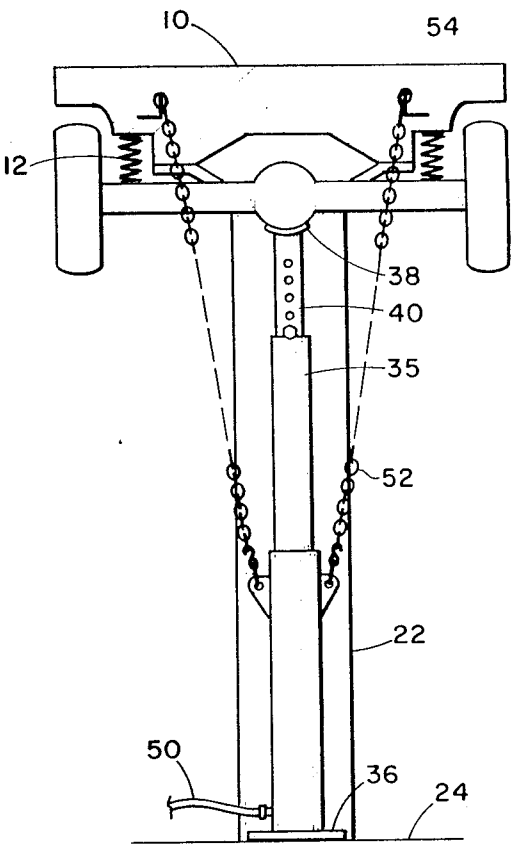
FIG. 9 is similar to FIG. 8 except that it illustrates the suspension system compressed.
Figure 8:
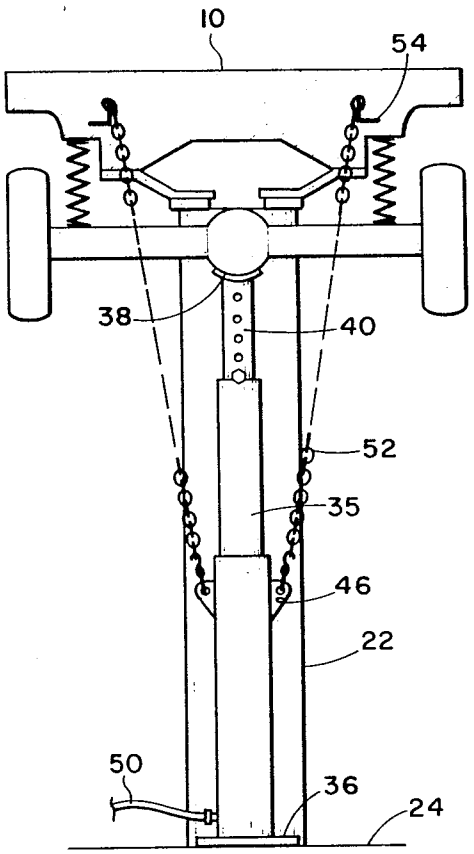
FIG. 8 is similar to FIG. 7 except my invention is in operating position.
Figure 7:
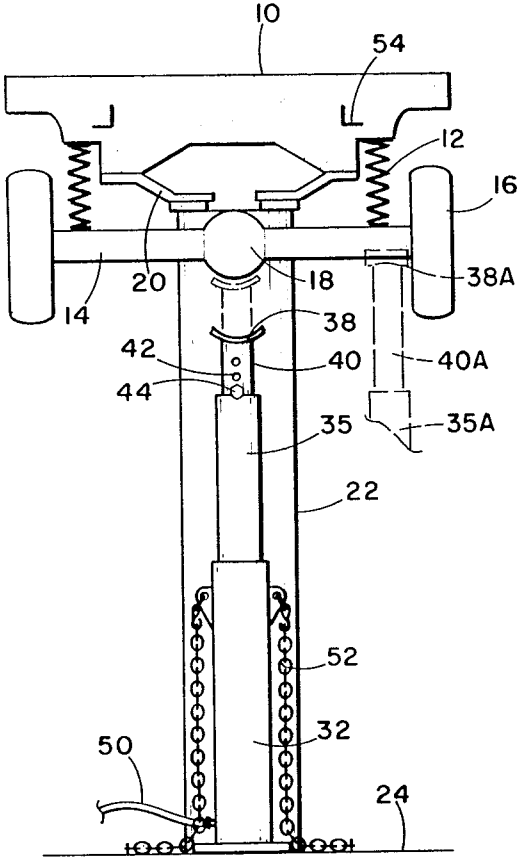
FIG. 7 shows a vehicle supported on a lifting rack.

Attention is next directed especially to FIGS. 7, 8 and 9 to illustrate the operation of my invention. Attention is first directed to FIG. 7 which shows an automobile having frame 10 lifted by arms 20 of hydraulic lift 22. As can be seen, axle 14 with differential 18 and wheels 16 are suspended by springs 12 which are now in tension rather than compression. As stated earlier, there are normally shock absorbers associated with springs 12. Also shown in FIG. 7 is the apparatus of one embodiment of my invention including housing 32 with chains 52 and extension 35 and second extension 40 with cradle 38. It is placed beneath a selected portion of the lower portion of the automobile and in this illustrated case below, differential 18. Second extension 40 is adjusted by placing pin 44 in the proper hole 42 so that the axle and wheels can be lifted the proper amount, taking into account the length of the piston stroke 32. It is to be noted that frame 10 has hooks or holes 54 which are found on most automobiles and are the same hooks or holes which are used to secure the vehicle to the transport truck when they are being hauled.

Attention is next directed to FIG. 8 in which chains 52 are attached to hooks 54. These chains are strong high-quality steel and are connected between ears 46 and hooks 54 so that the chain is taut with as little slack as possible.

Attention is next directed to FIG. 9 in which I continue to add air pressure through hose 50 to drive the piston upqardly so that extension 35 is extended to lift the axle and wheels upwardly so that there is no tension on springs 12 which are now in compression. I can accomplish this because chains 52 are attached to hooks 54 which prevents upward movement of frame 10 inasmuch as it is held in a fixed position with respect to floor 24 by cables 52 and housing 32. It is to be noted that the same reaction force of the force that drives extension 35 upwardly is applied against floor 24 through bast plate 36. I am now free to work on the suspension system or any other part of the car when it is held in position as shown in FIG. 9. This is because frame 10 cannot go up because of the chains 52 holding it in place and it cannot go down because arms 20 hold it up and, on the other hand, the lower portion which includes the axle 14, differential 18 and wheel 16 cannot go down because it is held up by cradle 38 and the lifting and holding apparatus illustrated in FIGS. 4 and 5. Although I have shown this and described it in relation to removing shock absorbers from the rear of a car or motor vehicle, it is not to be limited to such description. For example, it can be used in conjunction with essentially anything when its removal would take weight off the vehicle and cause it to tilt such as for example, removal of a motor.

If desired, the cradle 38 can be positioned under the axle 14 adjacent a rear wheel as indicated by dotted configuration 38A, 35A and 40A of the cradle extension and second extension in FIG. 7. The frame stays level here for the same principal shown above. The force on the arm 20 remains constant at any given position of my tool.

My invention can be used with lifting equipment other than that illustrated in FIG. 1. For example, it can be used with drive or single post lifts which has two parallel ramps upon which the wheels of the vehicle are driven.

While the invention has been described with a certain degree of particularity, it is manifest that many changes may be made in the details of construction without departing from the spirit and scope of this invention. It is understood that this invention is not limited to the embodiments set forth herein for purposes of exemplification, but is limited only by the scope of such claim or claims including the full range of equivalancy to which each element thereof is entitled.

What is claimed is:

1. A method of supporting a vehicle having an upper portion supported by a suspension system from a lower portion including wheels and axles which comprises:

lifting said vehicle to a selected height by applying upward force to said upper portion;

applying upward force to said lower portion including applying the upward force from a jack to said axles;

holding said upper portion against upward movement simultaneously with the step of applying upward force to move said lower portion upwardly including connecting chains between the upper portion and a housing of said jack.

2. A method as defined in claim 1 including performing mechanical operations on said vehicle while holding said upper portion against additional upward movement.

3. A method of supporting a vehicle having an upper portion supported by a suspension system from a lower portion including wheels and axles which comprises:

lifting said vehicle to a selected height;

thereafter applying upward force to said lower portion;

holding said upper portion against upward movement simultaneously with the step of applying upward force to said lower portion including connecting chains between the upper portion and a housing of said jack.

* * * * *